United States Patent [19]

Gorin

[11] 4,075,080

[45] Feb. 21, 1978

[54] COAL LIQUEFACTION PROCESS WITH REMOVAL OF AGGLOMERATED INSOLUBLES

[75] Inventor: Everett Gorin, Pittsburgh, Pa.

[73] Assignee: Continental Oil Company, Ponca City, Okla.

[21] Appl. No.: 659,180

[22] Filed: Feb. 18, 1976

[51] Int. Cl.[2] ..... C10G 1/04

[52] U.S. Cl. ..... 208/8; 210/83

[58] Field of Search ..... 208/8; 210/83

[56] References Cited

U.S. PATENT DOCUMENTS

| | | | |
|---|---|---|---|
| 3,607,717 | 9/1971 | Roach | 208/8 |
| 3,687,837 | 8/1972 | Fiocco et al. | 208/8 |
| 3,790,467 | 2/1974 | Fiocco et al. | 208/8 |
| 3,791,956 | 2/1974 | Gorin et al. | 208/8 |
| 3,852,182 | 12/1974 | Sze et al. | 208/8 |
| 3,852,183 | 12/1974 | Snell | 208/8 |
| 3,856,675 | 12/1974 | Sze et al. | 208/8 |
| 4,029,567 | 6/1977 | Farnand et al. | 208/8 |

*Primary Examiner*—Delbert E. Gantz
*Assistant Examiner*—James W. Hellwege
*Attorney, Agent, or Firm*—D. Leigh Fowler, Jr.; F. Lindsey Scott; William A. Mikesell, Jr.

[57] ABSTRACT

Production of a low ash liquid or liquefiable fuel from coal is effected by solvent treatment and separation of the undissolved solids. The latter are removed by first agglomerating the non-settling finely divided solids, and then effecting separation of the agglomerates in a downwardly moving ebullated bed of agglomerates where the upflowing fluidizing liquid is a wash solvent which preferably is a mixture of precipitating solvent and coal liquefaction solvent.

2 Claims, 1 Drawing Figure

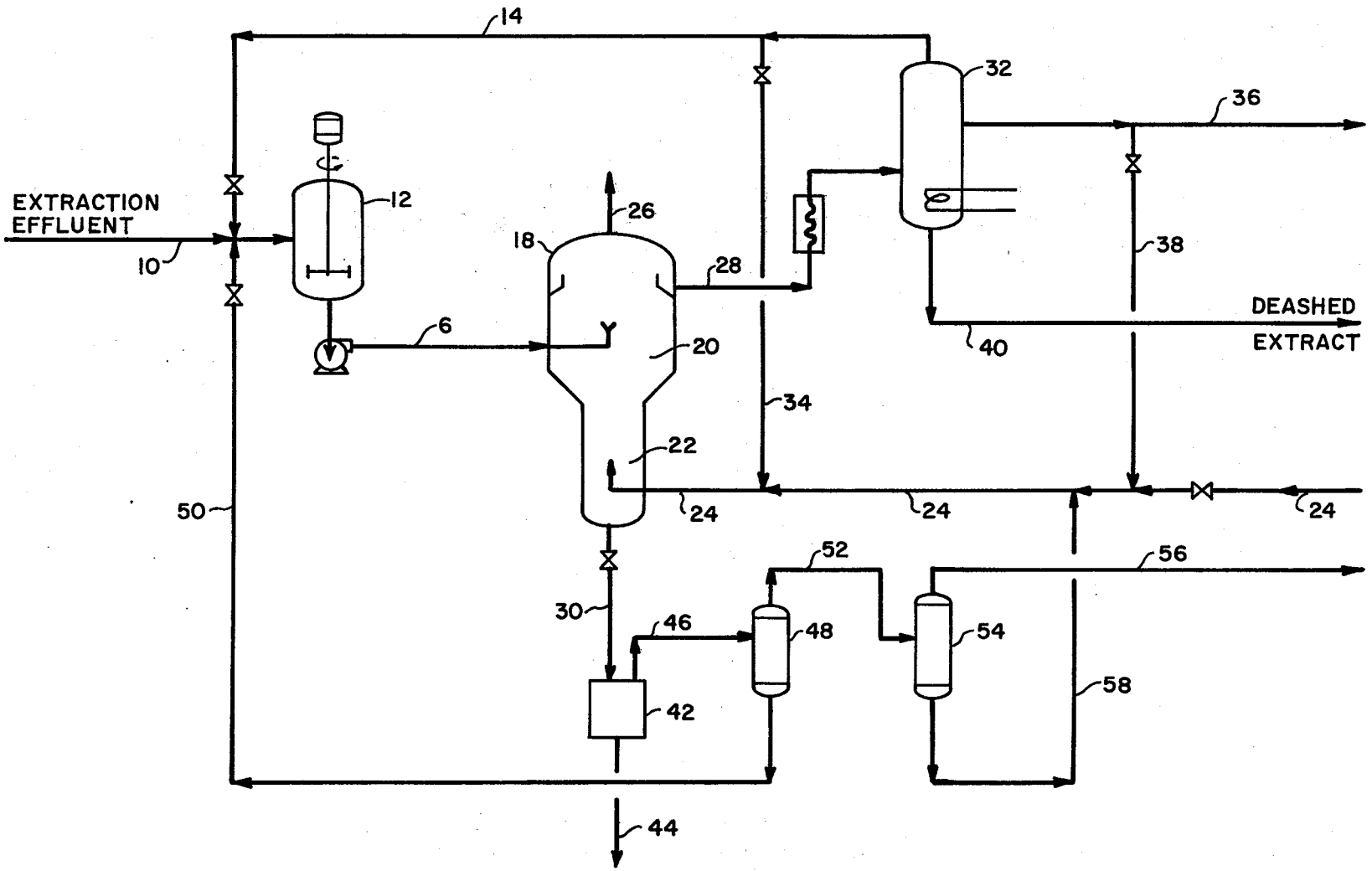
EXTRACTION EFFLUENT
DEASHED EXTRACT
10
12
14
18
20
22
24
26
28
30
32
34
36
38
40
42
44
46
48
50
52
54
56
58
6

COAL LIQUEFACTION PROCESS WITH REMOVAL OF AGGLOMERATED INSOLUBLES

BACKGROUND OF THE INVENTION

This invention relates to processes for the conversion of coal to a clean fuel, that is, a fuel which is substantially free of the mineral components normally found in coal.

In particular, the invention relates to coal liquefaction processes wherein a solvent (hereinafter sometimes called liquefaction solvent) is present during the liquefaction of the coal. Liquefaction may be achieved by hydrogenation, depolymerization, extraction, etc. The liquefaction solvent, which is generally coal-derived, may function as solvent for the coal or for the products, or both. It may also play a reactive role, for instance, in the depolymerization of the coal molecules. Examples of such coal liquefaction processes are described in U.S. Pat. Nos. 3,018,242; 3,117,921; 3,143,489; 3,158,561; 3,523,886; Re. 25,770; and 3,321,393.

The primary product of such coal liquefaction processes is a mixture of liquid and undissolved solids. Some gas is generally also produced. The liquid is a solution of coal liquefaction products dissolved in the liquefaction solvent. Some of the undissolved solids may be readily separated from the liquid by conventional solids-liquids separation processes such as filtration, centrifugation, sedimentation, hydroclones, etc. However, a large part of the undissolved solids (the amount being a function of the particular coal and the particular liquefaction treatment) appears as extremely finely divided particles of the order of ten microns or less in size. These particles are rich in mineral matter normally found in all coals. Upon combustion of the fuel which contains them, they form ash.

Efficient separation of such finely divided particles from the liquid in which they are suspended can either not be accomplished at all or at impractically low rates by the usual mechanical separation techniques at ordinary temperatures (i.e. by filtration, centrifugation, settling, or hydroclones) because of the extremely fine state of subdivision of the solid particles and because of the high viscosity of the liquid. Separation is improved by operation at elevated temperatures due to a rapid decrease in liquid viscosity, as well as an increase in the density differential between liquid and solid. Even at these elevated temperatures and reduced viscosities, the conventional separation techniques may be only partially effective.

The prior art offers many solutions to the problem of separation described above. Those which are pertinent to the present invention are those which use a precipitating solvent (sometimes called an anti-solvent) to effect agglomeration of the suspended solids, thereby permitting use of conventional solids-liquid separation techniques. Illustrative of the prior art pertinent to such agglomeration are the following U.S. Pat. Nos. 2,060,447; 2,631,982; 2,774,716; 2,871,181, 2,964,460; 2,989,458; 3,010,893; 3,018,241, 3,275,546; 3,519,553; 3,607,716; 3,607,717; 3,607,718; 3,607,719; 3,685,814; 3,642,608; and 3,687,837.

The most pertinent patent considered in connection with the preparation of this application is U.S. Pat. No. 3,791,956, patented Feb. 12, 1974 to Gorin, Kulik and Lebowitz.

The primary object of the present invention is maximum recovery of a product which is substantially free of mineral matter and undissolved coal.

SUMMARY OF THE INVENTION

In accordance with my invention, I propose an improvement in the process described in the above-cited U.S. Pat. No. 3,791,956 and particularly in the solids-liquid separation step thereof.

The coal liquefaction process yields a primary product containing, as a first component in a liquid state, a solution of liquefaction product in the liquefaction solvent and, as a second component, undissolved solids which are suspended in the first component. It is with the separation of this second component from the first component that the present invention is concerned.

The improvement proposed in accordance with the present invention is a single vessel for separating and washing the solids in such a manner as to minimize the loss of the desired liquefaction product by occlusion on the separated solids. The vessel has two freely intercommunicating settling zones, namely, an upper zone and a lower zone, the latter being smaller in cross-section than the upper zone. Effluent slurry from the coal liquefaction step is first subjected to an agglomeration step by the addition of a precipitating solvent so that agglomeration of the second component is effected. The resulting product consisting essentially of the agglomerates of the second component and the first component is introduced into the upper settling zone from which a clean solids-free liquid is recovered while the underflow therefrom passes downwardly into the lower settling zone of reduced cross-section. A wash solvent which preferably is a mixture of precipitating solvent and coal liquefaction solvent is continuously introduced into the lower zone and circulated upwardly through both settling zones. The function of the precipitating solvent in the preferred embodiment is to prevent redispersion of the agglomerates; the function of the coal liquefaction solvent is to dissolved the desired coal liquefaction product associated with the downwardly moving agglomerates. However, any suitable wash solvent may be used in my process with improved results. Such a wash solvent, for instance, may be any coal liquefaction solvent. The wash solvent flow rate to the lower zone is maintained at a rate higher than that of the rate of removal of liquid associated with the underflow solids product. In effect, a downwardly moving ebullated bed of solids is established and maintained in the lower zone. The solids collect as a relatively compact mass at the bottom of the lower zone and are withdrawn therefrom with very little occluded coal extract thereon.

DESCRIPTION OF THE DRAWING

The drawing is a schematic flowsheet of the preferred embodiment of the present invention.

General

Coal as used herein means any form of naturally occurring solid, ash-containing, hydrocarbonaceous substance, and includes, by way of example, bituminous and sub-bituminous coals, anthracite, and lignites.

The coal liquefaction process may be any of the processes commonly used now or hereafter by those skilled in the art wherein coal is converted at elevated temperature and pressure to a product in slurry form. A suitable liquefaction solvent is a mixture of polycyclic, aromatic hydrocarbons which is liquid under the conditions of temperature and pressure maintained during coal liquefaction. The solvent may be conveniently derived as a distillate fraction in the overall coal liquefaction process; in other words, from the coal itself.

The product of the selected coal liquefaction process consists essentially of a solution of the desired coal liquefaction product in the liquefaction solvent, and undissolved solids. The solids may contain some solids which are readily separable from the liquid, but generally, no attempt is made to separately remove readily separable solids since each such separation entails added cost and some loss of desired product, and the larger particles may actually aid in the removal of the smaller particles.

Agglomeration of the solids which are suspended in the liquid is effected by mixing a precipitating solvent (sometimes called "anti-solvent") which is miscible with the liquid (sometimes called herein "first component"). A suitable precipitating solvent is an aliphatic or naphthenic hydrocarbon or a mixture of aliphatic or naphthenic hydrocarbons derived in the coal liquefaction process itself or extraneously from petroleum sources. Generally, a precipitating solvent is selected which preferably boils within the temperature range of 150° and 225° C. Lower boiling solvents may also be used, but suffer the disadvantage of requiring operation of the separation device at higher pressures. The selection of precipitation solvent depends also on economic factors such as cost of separation from the liquefaction solvent and the type of solids separator. The precipitating solvent is miscible with the liquefaction solvent but does not readily dissolve the benzene-insoluble components of the coal liquefaction product. Hence, when added in sufficient amount under proper conditions to the coal liquefaction product, a precipitate is formed.

The proper conditions selected for agglomeration of the suspended solids (sometimes herein called "second component") are as follows. The temperature is maintained between about 200° and 357° C. and preferably between 260° and 315° C., by any suitable means. The pressure is maintained sufficiently high to be greater than the vapor pressure of the liquid at the operating temperature to prevent loss of the precipitating solvent and is generally between 5 and 200 psig. The weight ratio of precipitating solvent to the first component generally lies between 0.1 and 1.0. By thus regulating the conditions for agglomeration of the second component, a controlled amount of high molecular weight hydrocarbonaceous material, largely benzene-insolubles, is precipitated. The mixture is stirred very vigorously so that the precipitated material is uniformly dispersed and distributed over the suspended solids to serve, apparently, as a binder in the formation of agglomerates. Care must be taken to allow sufficient time for the desired agglomeration to occur. Generally, a minimum time of about 5 minutes is required. However, the minimum time required is a function of the other variables as well as the particular composition of the coal liquefaction product.

PREFERRED EMBODIMENT

The preferred embodiment of this invention, namely the separation of the first and second components in the slurry product obtained from the coal liquefaction process is hereinafter described.

Solids-laden liquid effluent in slurry form, a product of the selected coal liquefaction process, is conducted through an effluent conduit 10 to a mixer-agglomerator 12. The effluent has had any vaporous and gaseous products suitably flashed off before introduction into the mixer-agglomerator. The function of the mixer-agglomerator is to convert the suspended solids which constitute the second component to agglomerates that may be readily separated from the liquid. The desired agglomeration is accomplished by mixing a precipitating solvent with the effluent mixture in the proper proportions and under the proper conditions of temperature, pressure, agitation, and holding time.

The preferred precipitating solvent is an aliphatic or naphthenic hydrocarbon or mixture of hydrocarbons of the type having a normal boiling point or boiling range within the temperature range of 150° to 225° C. For example, suitable precipitating solvents are cyclohexane, n-decane, decalin, etc. Suitable precipitating solvents do not ordinarily occur in the solids- laden liquid effluent from the coal liquefaction operation, at least in sufficient quantity to effect the agglomeration, but may be recovered from subsequent extract hydrocracking and hydrotreating steps if such are incorporated in the process, or may be obtained from extraneous sources.

The initial boiling point of the coal liquefaction solvent introduced with the slurry through line 10 is generally adjusted to be substantially higher than that of the endpoint of the precipitating solvent, i.e. usually about 250° C. or higher. This ensures efficient recovery of the precipitating solvent by fractionation for recycle.

Precipitating solvent is introduced into the agglomerator 12 through a valved conduit 14 that connects with conduit 10. The weight ratio of precipitating solvent to the coal liquefaction solvent contained in the effluent should be between 0.1 and 0.75. The temperature within the agglomerator 12 is maintained between 260° and 315° C. by any suitable means. The pressure is maintained sufficiently high to assure that the precipitating solvent remains liquid. By thus regulating the conditions in the agglomerator, a controlled amount of high molecular weight hydrocarbonaceous material, most if not all of which is benzene-insoluble, is precipitated. The mixture is stirred very vigorously so that the precipitated material is uniformly dispersed and distributed over the suspended solids to act apparently as a binder in the formation of the agglomerates. Care must be taken to allow sufficient time for the desired agglomeration to occur. Generally, a minimum time of about five minutes is required. However, the minimum time required is a function of the other variables as well as the particular composition of the liquid effluent fed to the agglomerator. If desired, more than the required amount of precipitating solvent for effective agglomeration may be added, for certain of the soluble metallo-organo compounds are removed from solution thereby.

The effluent mixture of liquid and agglomerated solids, together with the added precipitating solvent and any added coal liquefaction solvent is pumped through a conduit 16 into settling vessel 18 near the center thereof. The latter consists of a generally cylindrical upper section connected to a generally cylindrical lower section of reduced cross-sectional area as compared to that of the upper section. The upper section is adapted to confine an upper settling zone 20 wherein a supernatant relatively quiescent zone of liquid is maintained, and a lower settling zone 22 wherein a mildly agitated slurry zone is maintained.

A mixture of precipitating solvent and coal liquefaction solvent is introduced centrally into the lower portion of zone 22 through a conduit 24, and is circulated upwardly through zones 22 and 20 respectively, to serve as a wash solvent. The upflow velocity of this mixture of solvents is just high enough to create a washing action on the solid agglomerates descending into the lower zone 22 whereby extract is removed by the upflowing mixture of solvents. The volume of wash liquid is not high enough to substantially increase the liquid upflow velocity in the upper zone 20, because of the much larger volume of liquid maintained therein. The entering agglomerates are thus allowed to settle or descend with minimum disturbance into the lower washing zone 22. The level of liquid maintained in the upper zone 20 is well above the entry point of the agglomerate-laden liquid. Hence, a quiescent layer of clear liquid may be readily maintained above the point of entry. In effect, what is established is a downwardly moving ebullated bed of solids in the lower zone 22.

Gas and vapors are suitably vented from the top of the settling vessel 18 through a conduit 26. Clarified liquid consisting of coal extract (which is essentially non-distillable), liquefaction solvent (which is distillable at relatively high temperatures), and precipitating solvent (which distills below the liquefaction solvent) is withdrawn through conduit 28. The washed agglomerates with little occluded or entrained coal extract are withdrawn from the bottom of the lower washing zone 22 through a conduit 30.

The now-clarified liquid is conducted through the conduit 28 to a fractionator 32. The liquid may conveniently be separated into three or more fractions. The lowest boiling fraction may be used as the precipitating solvent and, if so, is recycled through conduit 14, except for that portion needed to form the wash solvent mixture. That portion is diverted through a valved conduit 34 to connect with conduit 24. A middle distillate fraction boiling in the approximate range of 250° C. to 425° C. is recovered through conduit 36 and may serve, in part at least, as recycle coal liquefaction solvent. A portion is diverted through a valved conduit 38 which connects with conduit 24. Any requisite make-up of precipitating solvent is introduced into conduit 24. Thus, any desired mixture of precipitating solvent and liquefaction solvent may be made to obtain the optimum wash solvent for introduction into the lower washing zone 22. The preferred mixture however consists of the same proportion of precipitating solvent to coal liquefaction solvent as is present in the feed slurry entering the settler through line 16. However, the precise optimum relative proportions are a function of the coal and the liquefaction conditions, and may readily be found by a few routine tests. The essentially non-distillable fraction is recovered through conduit 40 for whatever further treatment, if any, that may be desired, such as hydrocracking to distillate fuels; or may simply be used as an ash-free fuel.

The underflow from zone 22 withdrawn through conduit 30 consists essentially of ash-containing hydrocarbonaceaus agglomerates with some entrained solvents and coal extract. The entire underflow is subjected to low temperature carbonization in any conventional equipment adapted to that purpose, schematically designated by the number 42. The primary products of such low temperature carbonization are gaseous and vaporous products and a char. The latter is withdrawn through a conduit 44 for any suitable use such as fuel, or feedstock for making synthesis gas by the steam-carbon reaction. The gaseous and vaporous products containing finely divided char particles are withdrawn through a conduit 46 to a conventional "hot" scrubber 48 wherein solids-laden pitch (which resembles coal extract in many respects) may be withdrawn through a conduit 50 for recycle through the agglomerator. The gases and more volatile vapors are withdrawn through a conduit 52 to a conventional "cold" scrubber 54 which serves to separate gas (withdrawn through conduit 56) from condensed vapors withdrawn through a conduit 58 which, if desired, may be connected with conduit 24 to supply additional coal liquefaction solvent.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. In a coal liquefaction process employing a liquefaction solvent wherein a product is recovered which contains a solution of coal liquefaction products in said liquefaction solvent as a first component, and as a second component, the undissolved solids suspended in said first component; and wherein said second component is agglomerated in an agglomeration zone by the use of a precipitating solvent, the IMPROVEMENT whereby the agglomerates of the second component formed in said agglomeration zone are separated from the first component substantially free of the desired coal liquefaction product, which improvement comprises:

a. conducting the mixture of said first component and agglomerated second component from said agglomeration zone to an upper settling zone from which a solids-free liquid is recovered, said upper settling zone freely communicating with a lower washing and settling zone which is smaller in cross-section than said upper zone;

b. circulating a wash solvent upwardly through said lower zone and said upper zone at such a flow rate in said lower zone as to establish and maintain a downwardly moving ebullated bed of solids in said lower zone, whereby agglomerates descending from said upper zone through said lower zone are continuously washed by said wash solvent; and c. withdrawing agglomerates from the bottom of said lower zone.

2. A process according to claim 1 wherein said wash solvent is a mixture of precipitating solvent and coal liquefaction solvent.

* * * * *